US008202123B1

(12) United States Patent
Lin et al.

(10) Patent No.: US 8,202,123 B1
(45) Date of Patent: Jun. 19, 2012

(54) CONNECTOR

(75) Inventors: Jui-Pin Lin, New Taipei (TW); Hung-Chi Wang, New Taipei (TW); Ming-Chun Lai, New Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 13/045,827

(22) Filed: Mar. 11, 2011

(51) Int. Cl.
*H01R 13/648* (2006.01)

(52) U.S. Cl. ..... 439/607.54; 439/607.35

(58) Field of Classification Search . 439/607.35–607.58
See application file for complete search history.

(56) References Cited

U.S. PATENT DOCUMENTS

| | | | | |
|---|---|---|---|---|
| 5,954,540 | A * | 9/1999 | Wu | 439/607.53 |
| 6,142,828 | A * | 11/2000 | Pepe | 439/607.43 |
| 6,217,378 | B1 * | 4/2001 | Wu | 439/567 |
| 6,264,505 | B1 * | 7/2001 | Clary | 439/607.41 |
| 6,416,359 | B1 * | 7/2002 | Zhang et al. | 439/607.37 |
| 6,450,835 | B1 * | 9/2002 | Lee | 439/607.4 |
| 6,475,033 | B1 * | 11/2002 | Zhu et al. | 439/607.4 |
| 6,619,986 | B1 * | 9/2003 | Yeh | 439/607.4 |
| 6,652,317 | B2 * | 11/2003 | Shao | 439/607.35 |
| 7,086,901 | B2 * | 8/2006 | Zhang | 439/607.56 |
| 7,150,651 | B1 * | 12/2006 | Yuan et al. | 439/607.54 |
| 7,351,105 | B2 * | 4/2008 | Delaney et al. | 439/607.36 |
| 7,695,319 | B1 * | 4/2010 | Yang et al. | 439/607.37 |
| 7,727,019 | B2 * | 6/2010 | Droesbeke et al. | 439/607.35 |
| 7,824,220 | B2 * | 11/2010 | Chen | 439/607.35 |
| 7,833,057 | B1 * | 11/2010 | Yang et al. | 439/607.4 |
| 7,883,369 | B1 * | 2/2011 | Sun et al. | 439/607.35 |
| 7,883,371 | B1 * | 2/2011 | Chen et al. | 439/607.41 |
| 7,883,372 | B1 * | 2/2011 | Sun et al. | 439/607.55 |
| 7,922,535 | B1 * | 4/2011 | Jiang et al. | 439/607.35 |
| 7,931,501 | B1 * | 4/2011 | Chiang | 439/607.35 |
| 7,997,937 | B2 * | 8/2011 | Kondo | 439/660 |
| 8,011,969 | B2 * | 9/2011 | Wang et al. | 439/660 |
| 8,142,225 | B2 * | 3/2012 | Yu | 439/607.35 |
| 2001/0053630 | A1 * | 12/2001 | Shi et al. | 439/607 |
| 2003/0017744 | A1 * | 1/2003 | Shao | 439/607 |
| 2003/0157836 | A1 * | 8/2003 | Morikawa et al. | 439/607 |
| 2003/0171014 | A1 * | 9/2003 | Lin | 439/79 |
| 2007/0105440 | A1 * | 5/2007 | Delaney et al. | 439/607 |
| 2009/0258539 | A1 * | 10/2009 | Zheng et al. | 439/607.41 |
| 2010/0240255 | A1 * | 9/2010 | He et al. | 439/607.35 |
| 2010/0291799 | A1 * | 11/2010 | Ting et al. | 439/607.58 |
| 2011/0124226 | A1 * | 5/2011 | Xiao | 439/607.55 |
| 2011/0312218 | A1 * | 12/2011 | Song | 439/607.36 |
| 2012/0071027 | A1 * | 3/2012 | Yu | 439/607.4 |

* cited by examiner

*Primary Examiner* — Ross Gushi
(74) *Attorney, Agent, or Firm* — WPAT, P.C.; Anthony King

(57) ABSTRACT

A connector includes an insulating housing, a plurality of terminals assembled in the insulating housing, and a shielding shell curved from a metal plate to show a substantially rectangular tubular shape with a receiving space therein. Two free ends of the metal plate are acted as a pair of jointing plates end-to-end jointed with each other. Two end edges of the jointing plates jointed together each have a portion bent downward beyond a level plane of the jointing plates and then extended overstride the joint of the jointing plates to form a reinforcing portion. The reinforcing portion of one jointing plate is superposed against a bottom face of the other jointing plate and further welded with the other jointing plate together to ensure the jointing plates firmly jointed with each other. The insulating housing with the terminals is inserted rearward in the receiving space of the shielding shell.

3 Claims, 2 Drawing Sheets

CONNECTOR

BACKGROUND OF THE INVENTION

1. Field of the Invention

The present invention relates to a connector, and more particularly to a connector having a shielding shell.

2. The Related Art

A traditional connector includes an insulating housing, a plurality of terminals assembled in the insulating housing respectively, and a shielding shell enclosing the insulating housing therein. The shielding shell has a top plate, two lateral plates extending downward from two opposite side edges of the top plate, and two jointing plates extending towards each other from bottom edges of the lateral plates. The jointing plates are engaged with each other by means of swallow-tailed buckling structures. For example, one of the jointing plates defines a swallow-tailed buckling groove, accordingly, the other jointing plate is provided with a swallow-tailed buckling block buckled in the buckling groove so as to make the jointing plates engaged with each other. However, the swallow-tailed buckling structures realize a poor joint between the jointing plates. As a result, when there is greater external force acted on the shielding shell, the jointing plates are easily separated from each other that further cause the shielding shell to fall off the insulating housing.

SUMMARY OF THE INVENTION

Accordingly, an object of the present invention is to provide a connector. The connector includes an insulating housing defining a plurality of terminal grooves thereon, a plurality of terminals assembled in the terminals grooves of the insulating housing respectively, and a shielding shell curved from a metal plate to show a substantially rectangular tubular shape with a receiving space therein. Two free ends of the metal plate are acted as a pair of jointing plates end-to-end jointed with each other. Two end edges of the jointing plates jointed together each have a portion bent downward beyond a level plane of the jointing plates and then extended overstride the joint of the jointing plates to form a reinforcing portion. The reinforcing portion of one jointing plate is superposed against a bottom face of the other jointing plate and further welded with the other jointing plate together to ensure the jointing plates firmly jointed with each other. The insulating housing with the terminals is inserted rearward in the receiving space of the shielding shell.

As described above, the reinforcing portions of the shielding shell overstride the joint of the jointing plates respectively to be superposed against the bottom face of the corresponding jointing plate, and further welded with the jointing plate together, so that effectively reinforce the joint of the jointing plates to make the jointing plates hardly uncoupled from each other even if there is greater external force acted thereon.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
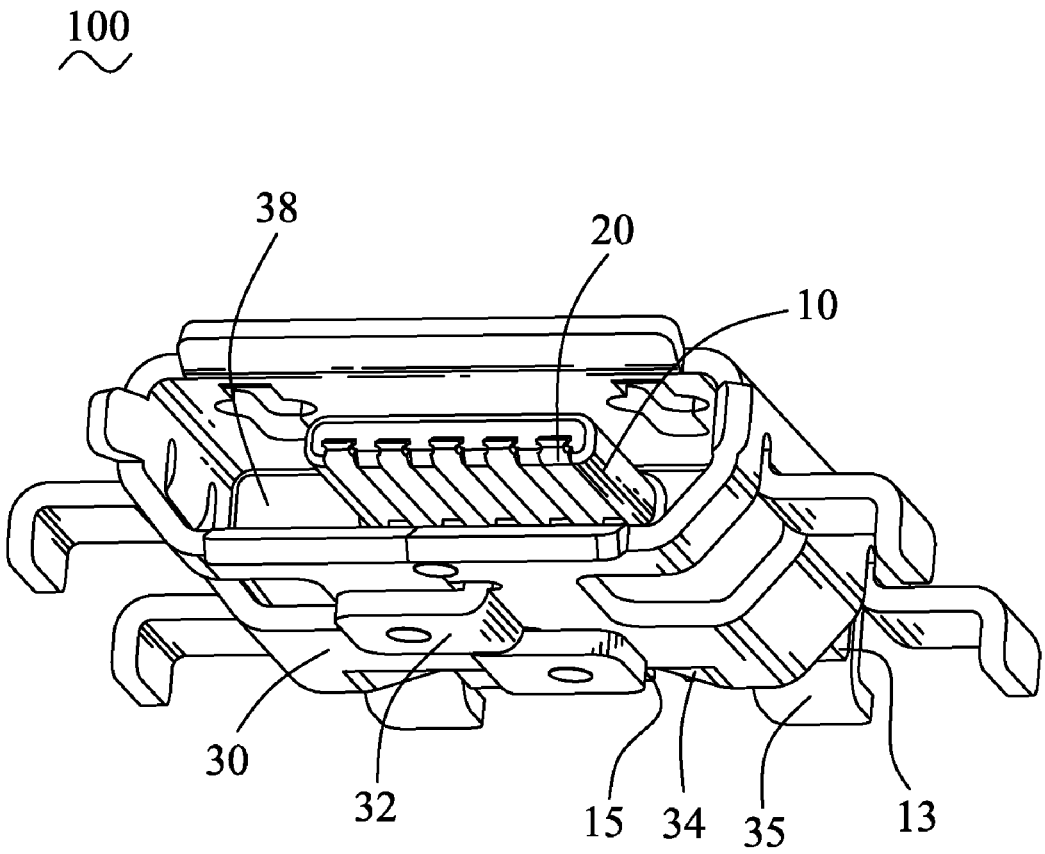
FIG. 1 is an assembled, perspective view of a connector of an embodiment in accordance with the present invention.
Figure 2:
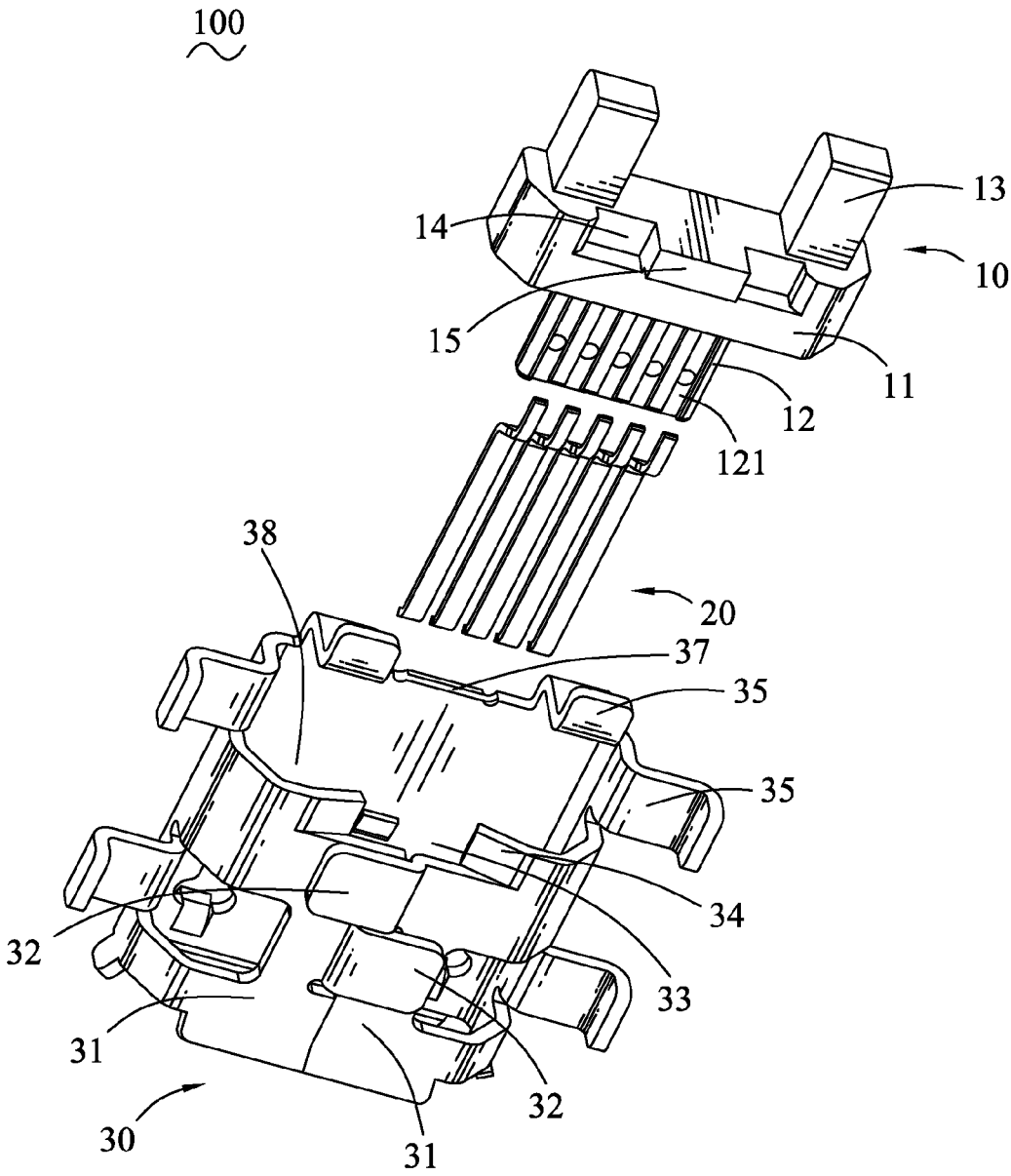
FIG. 2 is an exploded, perspective view of the connector shown in FIG. 1.

Referring to the drawings in greater detail, and first to FIGS. 1-2, the embodiment of the invention is embodied in a connector 100. The connector 100 includes an insulating housing 10, a plurality of terminals 20 assembled in the insulating housing 10, and a shielding shell 30 enclosing the insulating housing 10.

With reference to FIG. 2, the insulating housing 10 has a base 11 of substantially rectangular shape. A front of the base 11 extends frontward to form a tongue 12 having a smaller dimension than the base 11. A plurality of terminal grooves 121 is opened on a bottom surface of the tongue 12, and each extends frontward and rearward to the base 11. A rear of the base 11 has two opposite ends thereof protruded rearward to form a pair of resisting portions 13. A bottom of the base 11 defines a pair of locking recesses 14 spaced from each other along a direction perpendicular to the front-to-rear direction of the insulating housing 10. A portion of the bottom of the base 11 between the pair of locking recesses 14 protrudes downward to form a stopping block 15.

The shielding shell 30 is curved from a metal plate to show a substantially rectangular tubular shape with a receiving space 38 therein, and has two free ends of the metal plate acted as a pair of jointing plates 31 end-to-end jointed with each other. Two end edges of the jointing plates 31 jointed together each have a portion bent downward beyond a level plane of the jointing plates 31 and then extended towards the other jointing plate 31 to form a reinforcing portion 32. The reinforcing portion 32 of one jointing plate 31 is superposed against a bottom face of the other jointing plate 31 opposite to the receiving space 38, and further is laser welded with the other jointing plate 31 together. So the jointing plates 31 can be firmly jointed with each other to make the shielding shell 30 firmly enclose the insulating housing 10 therein. Rear ends of the jointing plates 31 are recessed forward to form an opening 33 of which two opposite side edges protrude towards each other to form a pair of locking slices 34 inclined upward into the receiving space 38 and spaced from each other. The shielding shell 30 has a top plate 37 facing to the jointing plates 31. The top plate 37 has two opposite side edges and a rear edge thereof bent downward and outward to form a plurality of soldering tails 35 arranged around the receiving space 38.

Referring to FIGS. 1-2, in assembly, the terminals 20 are assembled in the terminal grooves 121 of the insulating housing 10 respectively. Then the insulating housing 10 with the terminals 20 is inserted rearward into the receiving space 38 of the shielding shell 30, until rear ends of the resisting portions 13 are against the corresponding soldering tails 35 formed from the rear edge of the top plate 37 of the shielding shell 30. At this time, the locking slices 34 are locked in the locking recesses 14 of the insulating housing 10 respectively, and the stopping block 15 is clipped between the locking slices 34 and resists against rear edges of the jointing plates 31.

As described above, the reinforcing portions 32 of the shielding shell 30 overstride the joint of the jointing plates 31 respectively to be superposed against the bottom face of the corresponding jointing plate 31, and further laser welded with the jointing plate 31 together, so that effectively reinforce the joint of the jointing plates 31 to make the jointing plates 31 hardly uncoupled from each other even if there is greater external force acted thereon.

What is claimed is:

1. A connector, comprising:

an insulating housing defining a plurality of terminal grooves thereon;

a plurality of terminals assembled in the terminals grooves of the insulating housing respectively; and a shielding shell curved from a metal plate to show a substantially rectangular tubular shape with a receiving space therein, two free ends of the metal plate being acted as a pair of jointing plates end-to-end jointed with each other, two end edges of the jointing plates jointed together each having a portion bent downward beyond a level plane of the jointing plates and then extended overstride the joint of the jointing plates to form a reinforcing portion, the reinforcing portion of one jointing plate being superposed against a bottom face of the other jointing plate and further welded with the other jointing plate together to ensure the jointing plates firmly jointed with each other, the insulating housing with the terminals being inserted rearward in the receiving space of the shielding shell.

2. The connector as claimed in claim 1, wherein the insulating housing has a base and a tongue extending forward from a front of the base, a bottom of the base defines a pair of locking recesses spaced from each other, a portion of the bottom of the base between the pair of locking recesses protrudes downward to form a stopping block, rear ends of the jointing plates define an opening of which two opposite side edges protrude towards each other to form a pair of locking slices inclined upward into the receiving space and spaced from each other, the locking slices are locked in the locking recesses of the insulating housing respectively, and the stopping block is clipped between the locking slices and resists against rear edges of the jointing plates.

3. The connector as claimed in claim 2, wherein the shielding shell has a top plate facing to the jointing plates, the top plate has two opposite side edges and a rear edge thereof bent downward and outward to form a plurality of soldering tails arranged around the receiving space, a rear of the base has two opposite ends thereof protruded rearward to form a pair of resisting portions of which rear ends are against the corresponding soldering tails formed from the rear edge of the top plate of the shielding shell.

* * * * *